US005363662A

United States Patent [19]

Todack

[11] Patent Number: 5,363,662

[45] Date of Patent: Nov. 15, 1994

[54] REFRIGERANT RECOVERY AND RECYCLING METHOD AND APPARATUS

[76] Inventor: James J. Todack, 14407 Sycamore Lake Rd., Houston, Tex. 77062

[21] Appl. No.: 959,589

[22] Filed: Oct. 13, 1992

Related U.S. Application Data

[63] Continuation-in-part of Ser. No. 906,773, Jun. 30, 1992, abandoned.

[51] Int. Cl.[5] ..... F25B 45/00

[52] U.S. Cl. ..... 62/85; 62/149; 62/292; 62/77; 62/195; 62/475; 62/470

[58] Field of Search ..... 62/77, 85, 149, 292, 62/475, 195, 470, 472, 473, 474

[56] References Cited

U.S. PATENT DOCUMENTS

| | | | |
|---|---|---|---|
| 4,688,388 | 9/1987 | Lower et al. . | |
| 4,805,416 | 2/1989 | Manz et al. . | |
| 4,934,390 | 6/1990 | Sapp . | |
| 5,020,331 | 6/1991 | Michny . | |
| 5,022,230 | 6/1991 | Todack . | |
| 5,046,320 | 9/1991 | Michny . | |
| 5,086,630 | 2/1992 | Van Steenburgh, Jr. . | |
| 5,090,211 | 2/1992 | Peters . | |
| 5,167,126 | 12/1992 | Cartwright | 62/292 |
| 5,168,721 | 12/1992 | Hancock et al. | 62/292 |
| 5,182,918 | 2/1993 | Manz et al. | 62/149 |
| 5,193,351 | 3/1993 | Laukhuf et al. | 62/77 |

OTHER PUBLICATIONS

Data Sheet-Portable Refrigerant Recycle/Recovery System by Trane Company, 1991.

Data Sheet-Recycle/Recovery System by Trane Company, 1990.

Data Sheet-LIQUI/Jector by Osmonics, 1991.

*Primary Examiner*—John M. Sollecito

*Attorney, Agent, or Firm*—Honigman Miller Schwartz and Cohn

[57] ABSTRACT

A portable refrigerant recovery and recycling apparatus and method for removing and recycling chloroflourocarbon (CFC), hydroflourocarbon (HFC) and hydrochloroflourocarbon (HCFC) refrigerants from refrigeration systems through a closed loop connection which prevents the release of refrigerant to the atmosphere. A refrigerant is drawn by suction through a filter in its liquid state and transferred to a storage tank. When all liquid refrigerant has been so transferred, a refrigerant vapor recovery process automatically engages and retrieves and condenses the remaining refrigerant vapors, thus completing evacuation of the closed loop refrigeration system until the refrigeration system is evacuated to a pressure of approximately 29 inches Hg absolute for low pressure refrigeration systems and 20 inches Hg absolute for high pressure refrigeration systems, at which time the present invention automatically shuts off. By re-configuring connections to the refrigeration and storage system the stored refrigerant may be recycled through a distillation process which removes oil, water, acids and other solid particles. The distilled refrigerant is then recondensed and passed through high efficiency filters which further removes moisture and acids, thus rendering the refrigerant suitable for reuse.

26 Claims, 11 Drawing Sheets

FROM FIGS. 1, 2, AND 3

REFRIGERANT RECOVERY AND RECYCLING METHOD AND APPARATUS

CROSS REFERENCE TO RELATED APPLICATION

This application is a continuation-in-part of application Ser. No. 07/906,773 by James J. Todack, filed Jun. 30, 1992, now abandoned.

BACKGROUND OF THE INVENTION

1. Field of Invention

This invention relates to a method and apparatus for recovering and recycling refrigerants from refrigeration systems.

2. Discussion of the Related Art

In the past venting of refrigerants to the atmosphere, from refrigeration systems, was an expedient and economical method of removing contaminated refrigerants to permit repairs and allow the equipment to return to full production as quickly as possible. Scientific research has concluded that in the case of chloroflourocarbon (CFC) and related refrigerants, such venting to the atmosphere has led to the depletion of the stratospheric ozone layer. In view of this, various taxes and legislative restrictions have been imposed to limit the production, use, and restrict and discourage discharging of such refrigerants. Alternative refrigerants such as hydroflourocarbon (HFC) and hydrochloroflourocarbon (HCFC) may be used in place of CFC, but HFC and HCFC are more costly and their usage in present equipment is not compatible in all cases.

The above noted problems have necessitated the recovery, recycling and reuse of present and future supplies of refrigerants. The present invention relates to the field of recovery, recycling, transferring and recharging of refrigerants for servicing of refrigeration air conditioning and chilling systems that may utilize, but are not limited to, low pressure refrigerants such as R-11, R-113 and R-123, or high pressure refrigerants such as R-12, R-22, R-500, R-502 and R-134A. New laws will soon require every building owner having refrigeration equipment, air conditioning service technician and industrial plants to have means for handling refrigerants at the location of the refrigeration equipment when any work must be performed on the refrigeration equipment due to malfunction or routine maintenance.

Present refrigerant recovery and recycling apparatus which may clean large quantities of liquid and vapor refrigerants from large closed loop chilling systems are not easily transportable and require trained technicians for set up and operation during a recovery or recycling operation. Present recovery and recycling apparatus are large, complex, expensive and requires skilled technicians for proper operation. In addition, present refrigerant transfer systems are slow to transfer large quantities of refrigerant because this equipment has restricted flow rates which limit the transfer of refrigerant.

Under the proposed environmental laws, all refrigerants must be removed from the refrigeration equipment prior to servicing in an environmentally safe manor. The equipment necessary to recover refrigerants and be in compliance with the new environmental laws, as of 1993, must be able to reduce the pressure within the refrigeration equipment to 29 inches Hg absolute for low pressure systems, and 20 inches of Hg absolute for high pressure systems in order to insure removal of substantially all of the refrigerant contained therein. With the existence in the United States of over 85,000 low pressure closed loop refrigeration systems containing approximately 225,000 metric tons of low pressure refrigerants, the need for a reliable, cost effective, easy to use by minimally trained personnel and automatic unattended operation is most desirable and needed if the objective of reducing the release of refrigerants to the atmosphere is to be realized.

SUMMARY OF THE INVENTION

In contrast to present refrigerant recovery and recycling equipment, the present invention utilizes a self-contained hand cart design with sensors that automatically switch the function of refrigerant recovery from liquid vapor recovery while filtering the refrigerant being recovered. The present invention provides a refrigerant recovery system that connects to a refrigeration system for the recovery of all liquid and vapor refrigerants from the closed loop refrigeration system without need for skilled technicians to switch valve positions or reattach various hose configurations during the recovery operation. With a simple relocation of the hose connections. the present invention is capable of recycling the previously recovered refrigerant and return the recycled refrigerant to the refrigeration system for use therein.

By simplifying and automating much of the recovery and recycling operations, elimination or substantial reduction of accidental leakage of refrigerants to the atmosphere is achieved. Furthermore, the present invention may be easily connected to the refrigeration system and properly operated by just one relatively unskilled technician. Another feature of the present invention provides for the ability to remove solid particles, moisture, oil and acids from the recovered refrigerant and thus, render it suitable for reuse. Moreover, there exists a need for such apparatus which can effectively and economically reprocess large quantities of refrigerants and be portable and easily handled by one person.

The present invention is directed to an environmental protective method and apparatus for withdrawing refrigerants from refrigeration systems with the ability to transfer, recycle and recharge the refrigerants for use without allowing the escape of refrigerant to the atmosphere. A refrigerant recovery and recycling apparatus and method in accordance with the present invention includes a vacuum pump for low pressure systems or a compressor for high pressure systems to produce a pressure differential between the refrigeration system and the storage tank during a liquid refrigerant recovery first mode of operation which causes the liquid refrigerant to pass through a filter prior to entering the storage tank, and a vapor refrigerant recovery second mode of operation which is automatically actuated by a liquid level sensor detecting a lack of refrigerant liquid in the system and causes automatically controlled solenoid valves to activate a cooling system to condense the refrigerant vapor to a liquid.

During the second mode vapor recovery the present invention continues to withdraw refrigerant from the refrigeration system until a required low pressure of 29 inches Hg absolute for low pressure systems or 20 inches of Hg absolute for high pressure systems is reached, thus, completely evacuating the refrigeration system of substantially all refrigerant. When the required low pressure is reached, a low pressure switch shuts off the vacuum pump or compressor and closes the appropriate solenoid valves, completing recovery of refrigerants from the refrigeration system.

If no further cleaning of the refrigerant is required, other than the initial particle filtration, the refrigerant may be transferred from the storage tank back to the refrigeration system in the same manner as it was initially recovered. If, however, additional cleaning of the refrigerant is required, connection hoses may be repositioned on the present invention, storage tank and refrigeration system for recycling of the refrigerant using a distillation process for removal of oil and solid particles, and partial removal of moisture and acids. The refrigerant vapors are withdrawn from the storage tank, condensed to a liquid state and are passed through high efficiency filters where substantially all of the remaining moisture and acids are removed.

The present invention utilizes a strap-on remote heating device which is thermostatically controlled and interlocked with the control system of the present invention. The purpose of this heating device is to sustain a constant source of heat which, in combination with the lowering of pressure within the storage tank by the vacuum pump, causes the liquid refrigerant in the storage tank to vaporize. This strap-on heating device is attached to the storage tank and greatly enhances vaporization of the liquid refrigerant contained therein. The refrigerant vapors are drawn out of the storage tank by the present invention's vacuum pump or compressor, through a pressure-reducing valve, oil separator and into the condenser where the vapors are condensed back into a liquid, which are then passed through high efficiency filters which further removes moisture and acids after which the filtered liquid reffigerant may be returned to recharge the refrigeration system or to a second storage tank, whichever is desired.

The system and method of the present invention is directed to the provision of a refrigerant recovery apparatus which includes a filter-separator having a refrigerant inlet for admitting refrigerant into the filter-separator and having both a liquid and vapor outlet. A vacuum pump or compressor having a suction inlet is connected through a pressure reducing valve and vapor-liquid differentiator to the vapor outlet of the filter-separator. The vacuum pump or compressor discharge outlet is also connected to the refrigeration system vapor inlet for pressurizing the refrigeration system. An external storage tank is connected to a liquid outlet of the filter-separator and a vapor outlet of the external storage tank connects to the vacuum pump or compressor suction inlet. The vacuum pump or compressor discharge increases the pressure within the refrigeration system while decreasing the pressure within the external storage tank. This pressure differential causes refrigerant to flow from the refrigeration system through the apparatus of the present invention to the external storage tank.

Within the filter separator is a liquid level sensor which detects the presence of refrigerant liquids. Refrigerant liquids are drawn into the filter-separator until a predetermined liquid level is reached, then a liquid recovery first mode of operation begins. In the liquid recovery first mode of operation the present invention receives liquid refrigerant from the refrigeratior system. This liquid refrigerant passes into the filter-separator wherein a filter means removes particles of rust and dirt from the liquid refrigerant. As long as there is liquid refrigerant flowing from the refrigeration system through the filter separator the apparatus of the present invention remains in the first mode. When the liquid level sensor detects substantially no refrigerant liquid remaining within the filter-separator, the apparatus of the present invention automatically switches to a vapor recovery second mode.

Operation of this second mode indicates that only refrigerant vapor remains within the refrigeration system. However, this vapor must be removed in order to comply with the new environmental laws. The present invention ceases pressurizing the refrigeration system but continues to withdraw refrigerant vapors therefrom. Refrigerant vapor is drawn through the filter-separator and exits a vapor outlet directly to a pressure reducing valve and into a liquid-vapor differentiator. The present invention utilizes a unique liquid-vapor differentiator which prevents liquid droplets of refrigerant from entering the suction inlet of the vacuum pump or compressor. If liquid were allowed to enter the vacuum pump or compressor, slugging would occur and could damage the vacuum pump or compressor.

The differentiator further utilizes a heat exchanger to vaporize liquid droplets of refrigerant suspended in the vapor. Heat is obtained by running the vacuum pump or compressor discharge through a heat exchanger contained within the differentiator. The differentiator is comprised of an inlet chamber and an outlet chamber wherein the inlet chamber is in vapor communication with the outlet chamber. A baffle barrier prevents refrigerant liquids from passing from the inlet chamber to the outlet chamber. Furthermore, the heat exchanger is in thermal communication with the outlet chamber to further enhance vaporization of liquid droplets contained in the refrigerant vapor. The refrigerant vapor flowing from the vacuum pump or compressor discharge passes through a coalescing oil separator filter which removes suspended oil contained within the refrigerant vapor. The filter media used in the coalescing oil separator may be, for example, a LIQUI/JECTOR (TM) manufactured by Osmonics, 5951 Clearwater Drive, Minnetonka, Minn. 55343.

After the vapor passes through the coalescing oil separator fiiter the vapor goes through the differentiator, a check valve and through a condenser which may use, for example, cooling water, air or other means to cool the refrigerant vapor to liquid. The condensed refrigerant liquid flows into the external storage tank. This vapor removal continues until a pressure of 29 inches of Hg absolute for low pressure systems or 20 inches of Hg absolute for high pressure systems is detected by a low pressure sensor such as, for example, a low pressure switch. On sensing this low pressure, the present invention stops the vacuum pump or compressor and closes solenoid valves to isolate refrigerant flow and terminate the refrigerant recovery operation. Upon termination of the recovery operation, substantially all of the refrigerant has been removed from the refrigeration system in compliance with the new environmental regulations. After the refrigeration system service valves are closed and the valves on the external storage tank are similarly closed, the present invention may be disconnected until next use.

When recycling (additional cleaning) of the refrigerant is required, the present invention may be reconnected so that refrigerant vapor may be removed from the external storage tank and recycled liquid refrigerant be placed back into the refrigeration system. This is accomplished by attaching the apparatus of the present invention to the vapor outlet of the external storage tank and the condensed refrigerant liquid outlet to the refrigeration system charging inlet, or into another empty container. A thermostatically controlled heater may be attached to the external storage tank in order to facilitate vaporization of the liquid refrigerant contained therein. As the refrigerant is vaporized, virtually all oil, free water, acids and solid particles are left behind in the storage tank. The distilled refrigerant vapors are drawn into the apparatus of the present invention, condensed to a liquid state and filtered for removal of the remaining moisture and acids after which the distilled and filtered refrigerant is ready for use in recharging the refrigeration system.

Other and further objects, features and advantages will be apparent from the following description of the presently preferred embodiment of the invention, given for the purpose of disclosure, and taken in conjunction with the accompanying drawings.

BRIEF DESCRIPTION OF THE DRAWINGS

FIG. 1A is a schematic process flow diagram of a refrigeration system connected to the invention of FIG. 1;

FIG. 1B is a schematic process flow diagram of a storage tank connected to the invention of FIG. 1;

FIG. 1C is a schematic process flow diagram of another embodiment of the present invention utilizing an air cooled condenser;

FIG. 4A is a schematic process flow diagram of a refrigeration system connectred to the invention of FIG. 4;

FIG. 4B is a schematic process flow diagram of a storage tank connected to the invention of FIG. 4;

DESCRIPTION OF THE PREFERRED EMBODIMENTS

Figure 1:
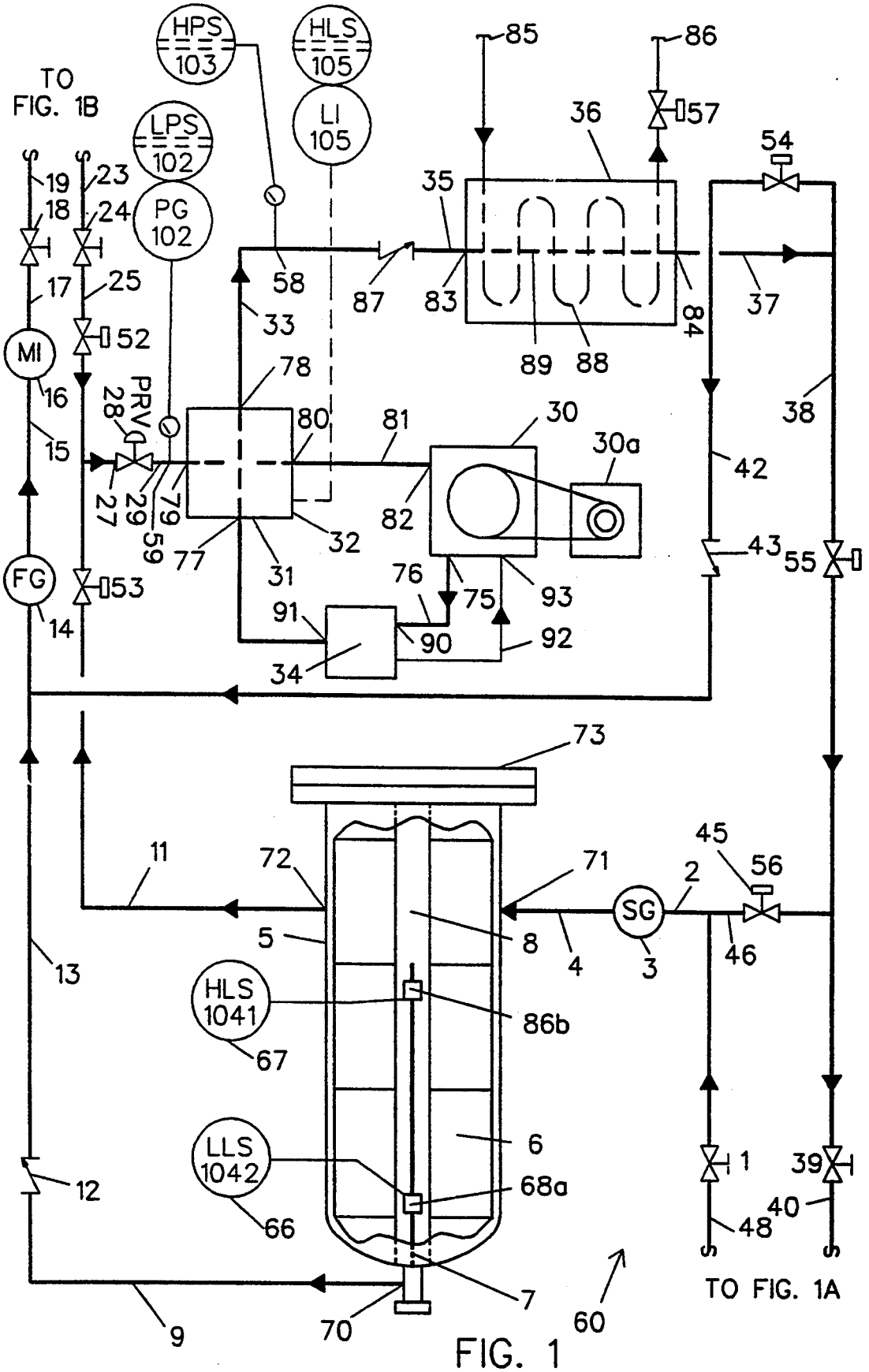
FIGS. 1, 1A, 1B and 1C schematic process flow diagrams of the present invention.
Figure 1B:
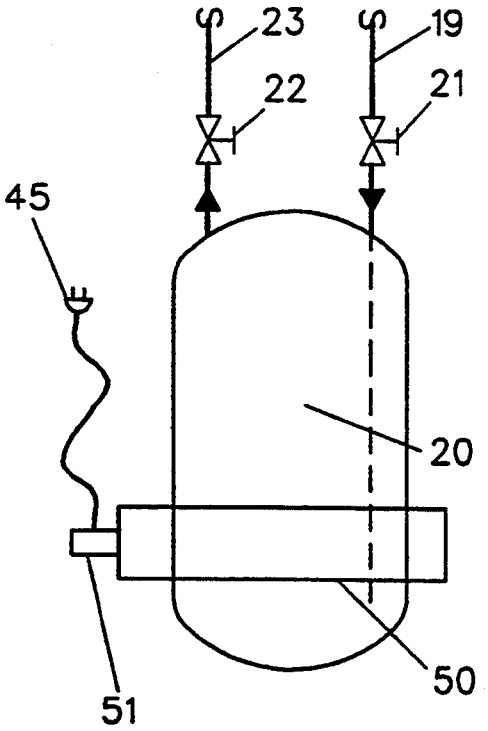
Figure 1A:
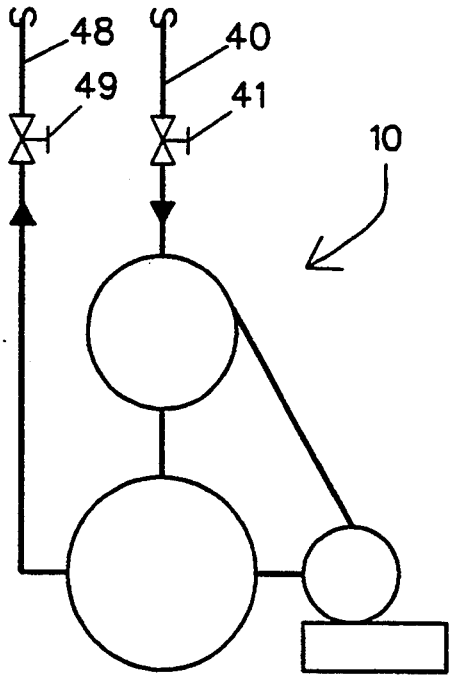
Figure 1C:
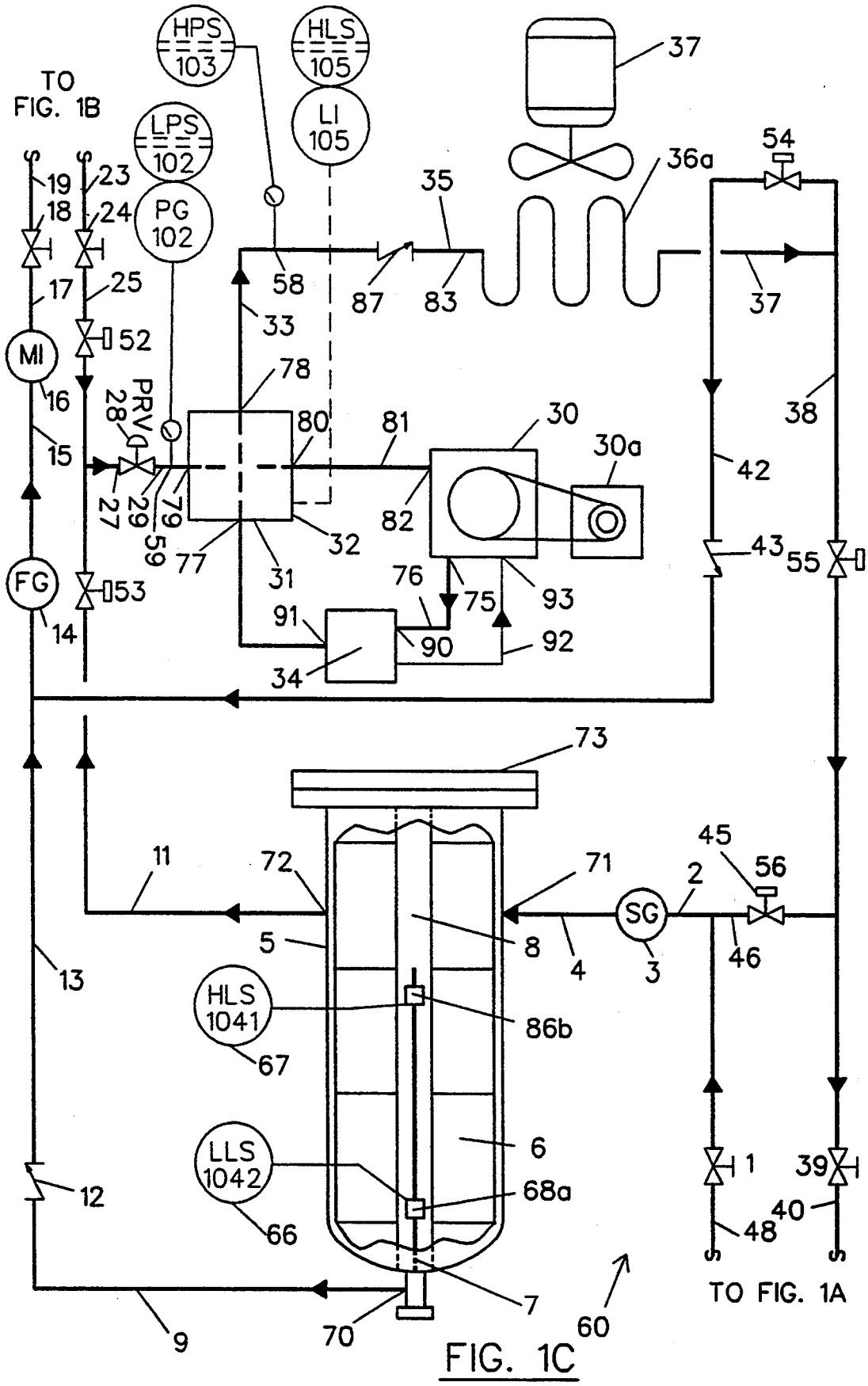

A better understanding of the present invention can be had when the following detailed description is read with reference to the drawings wherein common elements are designated with like numbers or letters. For purposes of illustration only, the present apparatus and process will be described in connection with reclaiming low pressure refrigerants such as, for example, R-11, R-113 and R-123, or high pressure refrigerants such as, for example, R-12, R-22, R-500, R-502 and R-134A which the method and apparatus of the present invention can recover and recycle in an efficient, cost effective and easy to operate manner.

Referring now to the drawings, particularly to FIGS. 1, 1A, 1B and 1C, the refrigerant recovery and recycling apparatus of the present invention is generally indicated by the reference numeral 60. During operation, the apparatus 60 is in fluid communication with a refrigeration system 10 and an external storage tank 20. The apparatus of the present invention may be fabricated on a hand cart (not illustrated) that may be easily relocated from one refrigeration system to another. The present invention is adapted for connection to a refrigeration system and is in fluid communication with refrigerant contained therein. In addition, the present invention is adapted for connection to an external storage tank 20 which is in fluid communication with the recovery apparatus 60. The apparatus 60 of the present invention comprises an inlet valve 1 connected to a sight glass 3 which is connected to a filter housing 5. The filter housing 5 contains filters 6, filtering screen 8 and liquid level sensor 7. Refrigerant enters the filter housing 5 through inlet 71 and exits through either liquid outlet 70 or vapor outlet 72. The filter housing 5 has an access cover 73 that is removable for servicing and replacement of the filters 6, filter screen 8 and liquid level sensor 7.

Figure 6:
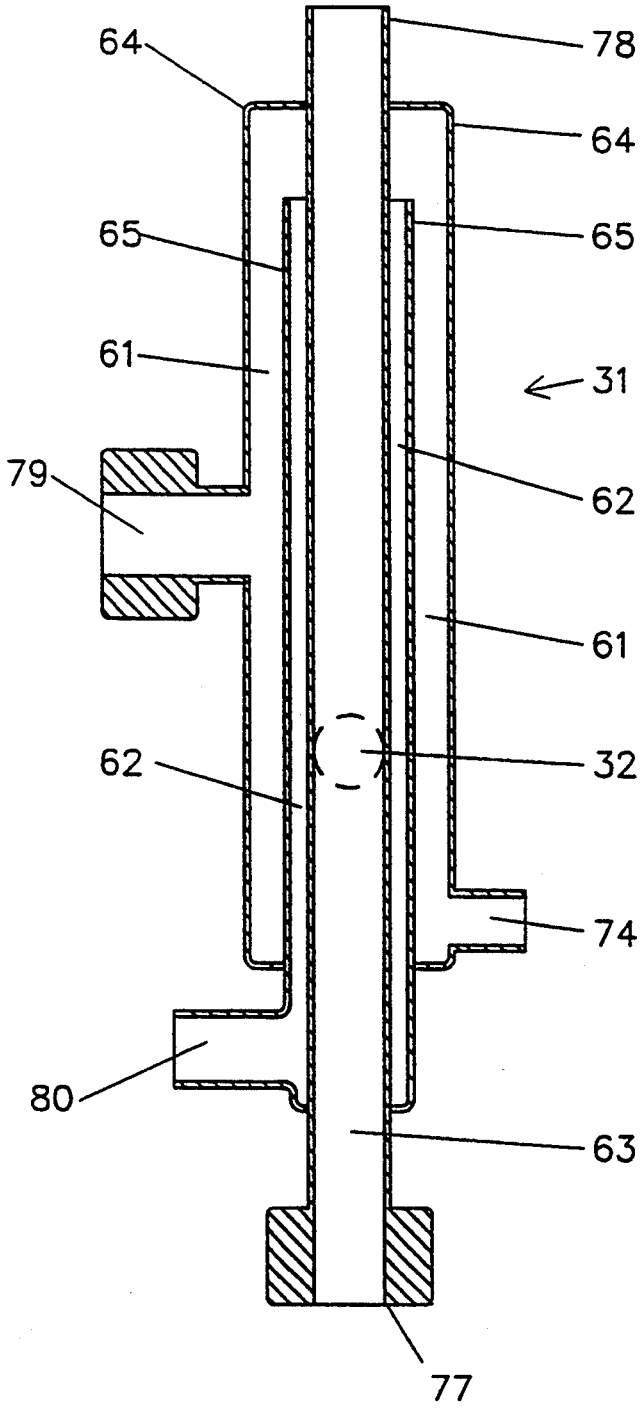
FIG. 6 is a cross-sectional elevational view of a vapor-liquid differentiator.

A vacuum pump (low pressure system) or compressor (high pressure system) (hereinafter "pressurization means") 30 is used to create a pressure differential between the refrigeration system 10 and the external storage tank 20. The pressurization means 30 may be electric motor driven. A coalescing oil separator 34 is utilized to remove oil in the refrigerant vapor. A differentiator 31 is used to prevent liquids from entering the suction inlet 82 of the pressurization means 30. The differentiator 31 may also be used to vaporize droplets of liquid refrigerant passing therethrough. A detailed cross sectional elevation of the differentiator 31 is illustrated in FIG. 6 and more fully described hereinafter. A check valve 87 prevents liquid from flowing back into the differentiator 31. A condenser 36 is used to condense the refrigerant vapor to a liquid. The condenser 36 is comprised of a reffigerant line 89 in which refrigerant passes therethrough. A condenser coil 88 in which cooling fluid such as, for example, water passes. Alternatively, an air cooled condenser **36*a* (FIG. 1C), using either air convection or forced air from a fan 37**, may be utilized as is well known to those skilled in the art of refrigeration systems.

The system and method of the present invention has three modes of operation. The first mode draws liquid refrigerant from the refrigeration system 10 by pressurizing the refrigeration system 10 to a higher pressure than the external storage tank 20. The pressurization means 30 discharge causes the pressure to increase within the refrigeration system and the pressurization means 30 suction causes the pressure to decrease within the external storage tank. The pressure difference between refrigeration system 10 and external storage tank 20 results in liquid refrigerant flowing from the refrigeration system 10 to the filter housing 5 where rust and sediment particles are removed by the filters 6 and filtering screen 8. As liquid refrigerant fills up the filter housing 5, liquid level sensor 7 detects the presence of liquids contained therein. So long as there is liquid refrigerant indicated by liquid level sensor 7, the system and method of the present invention continues to pressurize the refrigeration system 10, thus forcing out all liquid refrigerant contained therein. When liquid level sensor 7 detects an absence of liquid refrigerant in the filter housing 5, the system and method of the present invention switches to the second mode of operation.

The second mode of operation draws refrigerant vapor from the refrigeration system 10 by means of the pressurization means 30. Further pressurization of the system 10 is prevented by closing the solenoid operated valve 55. The system 10 is now in vapor communication with the present invention only through valve 49, and pump 30 begins to draw a vacuum therein. The vapor refrigerant is drawn through filter housing 5, exiting through vapor outlet 72, through line 11, and passing through open SOV 53. SOV 52 is now closed, preventing communication with the storage tank 20. Refrigerant vapor flow continues through the inlet 79 of differentiator 31, pressurization means 30, oil separator 34, through the discharge 78 of differentiator 31 and into condenser 36. The vapor is condensed to a liquid in condenser 36. The condensed liquid refrigerant passes through SOV 54, SOV 55 is now closed preventing flow into line 38. From SOV 54, liquid refrigerant flows through line 42, check valve 43, line 44 and line 13. Check valve 12 prevents liquid back flow into the filter housing 5. From line 13 the liquid refrigerant flows to the external storage tank 20.

The system and method of the present invention continues in this second mode until a desired low pressure is obtained as detected by low pressure sensor 59. This selected low pressure sensed by low pressure sensor 59 indicates that substantially no refrigerant remains in the refrigeration system 10. The system of the present invention may pull a vacuum of 29 inches of mercury (Hg) absolute which indicates effective removal of substantially all of the refrigerant contained therein.

The above two modes of operation allow withdrawal of substantially all of the refrigerant contained in the refrigeration system 10 and stores this refrigerant in external storage tank 20. Substantially no refrigerant is vented to the atmosphere during the operation of the present invention in these two recovery modes. The refrigeration system 10 may now be serviced without having residual refrigerant vented to the atmosphere, because substantially all of the refrigerant from refrigeration system 10 is now contained in external storage tank 20.

Refrigerant contained in external storage tank 20 may be returned to the refrigeration system 10 by the present invention in a third mode of operation, which through a distillation and filtering process may further remove entrapped oil, water, acids and particles contained in the refrigerant. The apparatus and method of the present invention removes the refrigerant contained in the tank 20 by reducing pressure and vaporizing the refrigerant liquid into a vapor. This vaporization process is enhanced by heating tank 20 and the liquid refrigerant contained therein.

Heating of tank 20 is accomplished by a thermostatically controlled heater 50, for example, a strap on electrical resistance heater that may be attached to the tank 20 and connected to an electrical supply through an electrical connection 45. A thermostat 51 controls operation of the strap-on heater 50 attached to storage tank 20. The heater 50 in conjunction with thermostat 51 supplies a constant source of heat to storage tank 20 and the liquid refrigerant contained therein. Supplying heat in combination with the lowering of pressure by the pressurization means is sufficient to cause any liquid refrigerants contained in tank 20 to vaporize, thus, maintaining a continuous vapor feed on the suction input 82 of the pressurization means 30 of the present invention.

The vapor from tank 20 flows through differentiator 31, pump 30, oil separator 34, check valve 87 and to condenser 36 wherein the vapor is condensed to a liquid. The condensed refrigerant liquid flows into filter housing 5 where water and acids may be removed from the liquid refrigerant by means of the filters contained therein. The filtered and distilled refrigerant liquid is placed back into the refrigeration system 10, or an appropriate container for reuse at a future time.

This third mode of recycling stored refrigerant continues until substantially all refrigerant has been removed from the storage tank 20 and a desired low pressure is reached, as detected by the low pressure sensor 59. Upon reaching a predetermined low pressure the apparatus of the invention shuts off after effectively removing substantially all of the refrigerant contained in tank 20 and transferring same to the refrigeration system 10, or an external holding tank.

LIQUID RECOVERY MODE

Figure 2:
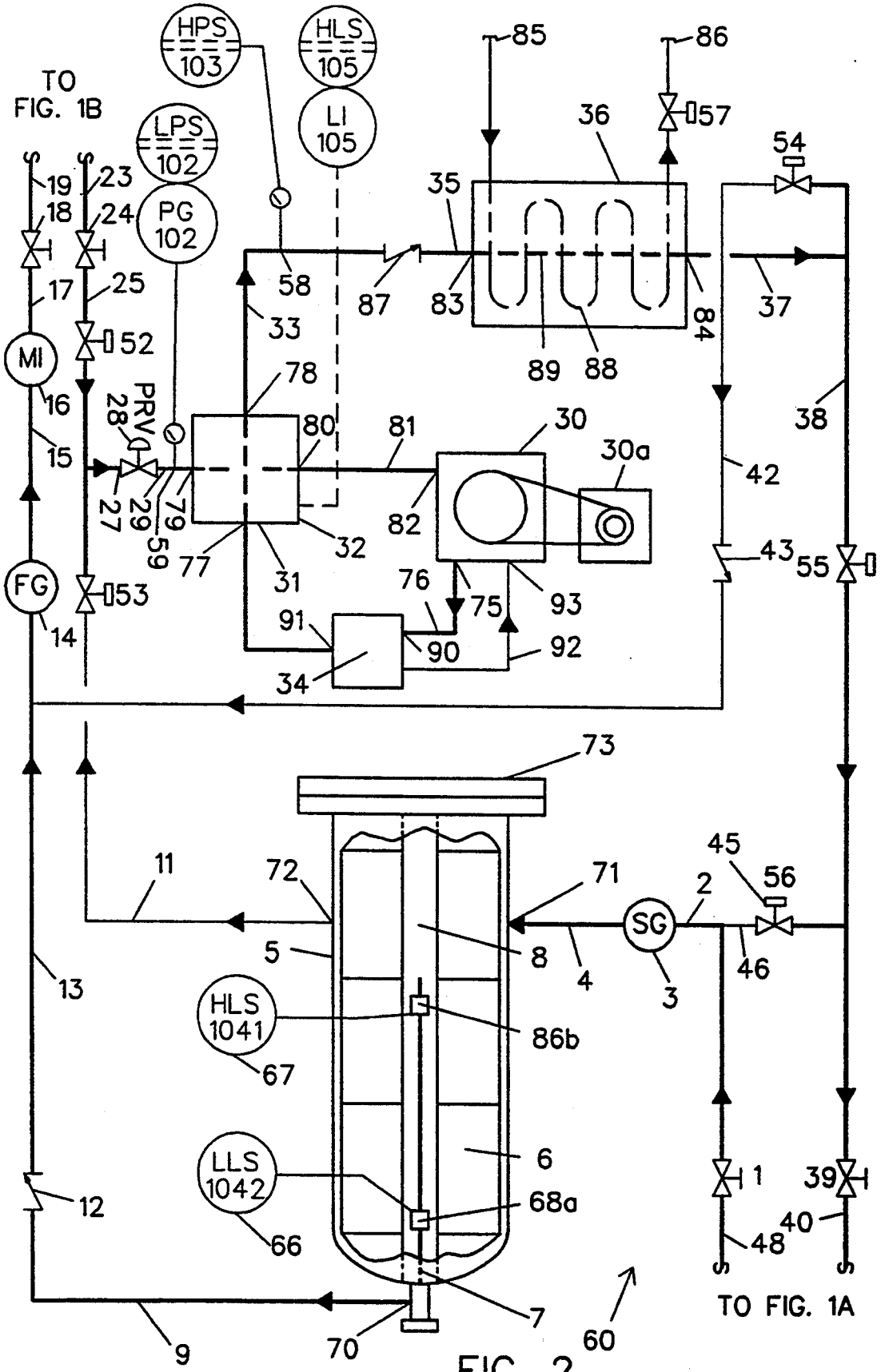
FIG. 2 is the schematic of FIG. 1 illustrating the liquid recovery mode of operation.

Referring now to FIG. 2, refrigerant flow is illustrated in a process schematic format. Liquid refrigerant contained in the refrigeration system 10 flows through open inlet charging valve 49 and hose 48 into inlet valve 1. Solenoid operated valve (SOV) 56 is closed, preventing any refrigerant flow through line 46. Therefore, refrigerant may only flow through line 2 wherein the refrigerant passes through sight glass 3 into line 4 connected to the filter housing 5 inlet 71. SOV 53 initially opens and the pressurization means 30 draws vapors out of the housing 5 through line 11. When the internal pressure of housing 5 is reduced, liquid refrigerant begins entering housing 5 through inlet 71. As the liquid refrigerant accumulates in the filter housing 5 liquid level sensor 7 detects the liquid refrigerant by, for example, low level switch 66 and high level switch 67. Switches 66 and 67 may be alternately actuated by liquid float 68, one at position float **68*a* or 68*b*, respectively. As liquid refrigerant accumulates within housing 5, the float 68 rises to float 68*b* position. Switch 67 causes the control logic of the invention to close SOV 53 and open SOV 52. With SOV 52 open, the storage tank 20 is connected through open valve 22, hose 23, and open valve 24 to the differentiator 31 and to the pressurization means 30. Pressurization means 30 reduces the pressure within tank 20**.

Liquid refrigerant from the system 10 flows through open valves 49 and 48, before entering inlet 71 of filter housing 5. Within housing 5, high efficiency felt filters 6 and filtering screen 8 remove rust, sediment and other large particles from the liquid refrigerant flowing therethrough. As pressure is reduced within the external storage tank 20, the filtered liquid reffigerant passes out of the filter housing 5 through outlet 70 through line 9 and check valve 12. Check valve 12 prevents liquid back flow into the housing 5. The liquid refrigerant continues on through line 13 through flow indicator and visual purity sight glass 14 and then through line 15 to moisture indicating sight glass 16. After passing through sight glass 16 the liquid refrigerant continues through line 17 to open liquid outlet valve 18. Outlet valve 18 is adapted for connection to hose 19 which connects to and is in fluid communication with open liquid inlet valve 21 of the external storage tank 20.

Refrigerant flows from the higher pressure refrigeration system 10 through the system of the present invention and into the lower pressure external storage tank 20 because of the pressure differential existing therebetween. Sufficient pressure differential is assured by actually removing refrigerant vapors, thus, reducing the pressure within tank 20 and causing refrigerant liquid to be drawn into the tank 20 through open inlet vaive 21.

Tank 20 is evacuated through an open vapor outlet valve 22 connected to hose 23 which in turn is connected to open valve 24. The vapor recovery inlet valve 24 is adapted for connection to hose 23 and draws vapor contained in tank 20. Vapor from tank 20 passes through open valve 24 through line 25 and then through open SOV 52. Vapor from tank 20 cannot pass into the filter housing 5 because SOV 53 is closed. Therefore, the vapor may only pass through pressure reducing valve (PRV) 28 which insures that pressurization means 30 cannot be over pressured. The vapor refrigerant continues from PRV 28 through line 29 into differentiator 31 which prevents substantially all liquids from entering the suction inlet 82 of pressurization means 30. The operation of differentiator 31 will be explained in more detail subsequently.

As refrigerant vapor passes through the differentiator 31, it continues on through line 81 to the suction inlet 82 of pressurization means 30. The discharge 75 of pressurization means 30 is connected through line 76 to a coalescing oil separator filter 34 which is adapted to remove oil fromm the refrigerant vapors passing therethrough. The vapor then passes into differentiator 31 heat exchanger inlet 77 where the heat from the vapor warmed from the discharge 75 of pressurization means 30 is used to heat the refrigerant vapor passing through the differentiator 31. As the refrigerant vapor passes from inlet 79 to outlet 80 of differentiator 31. the vapor is heated which causes substantially all liquid droplets of refrigerant to vaporize. The vapor continues in line 33 through a check valve 87 which prevents liquids from flowing back into the differentiator 31. After passing through check valve 87 the vapors enter condenser 36.

The filtered and differentiated refrigerant vapor passes through condenser 36 unchanged and through line 37 to SOV 55 which is open, allowing the vapor to pass through line 38 connected to open vapor valve 39 which is adapted for connection to the refrigeration system 10. Open valise 39 connects to hose 40 which in turn is adapted for connection to the refrigeration system vapor inlet valve 41 which is open. As the refrigerant vapor enters refrigeration system 10 it increases the pressure therein, thus, causing liquid refrigerant to flow out of open valve 49.

The liquid recovery mode continues to evacuate the refrigeration system 10 until substantially all of the liquid refrigerant contained therein is removed. When liquid level sensor 7, located in the filter housing 5, detects a lack of liquid refrigerant therein, low level switch 66 is actuated by float 68 when in the position illustrated as float 68*a*. The lack of liquid as indicated by the level sensor 7 in filter housing 5 causes a controller (FIG. 7) to open SOV 53, close SOV 52, open cooling water SOV 57, open SOV 54 and close SOV 55, thus, switching to the vapor recovery mode.

VAPOR RECOVERY MODE

Figure 3:
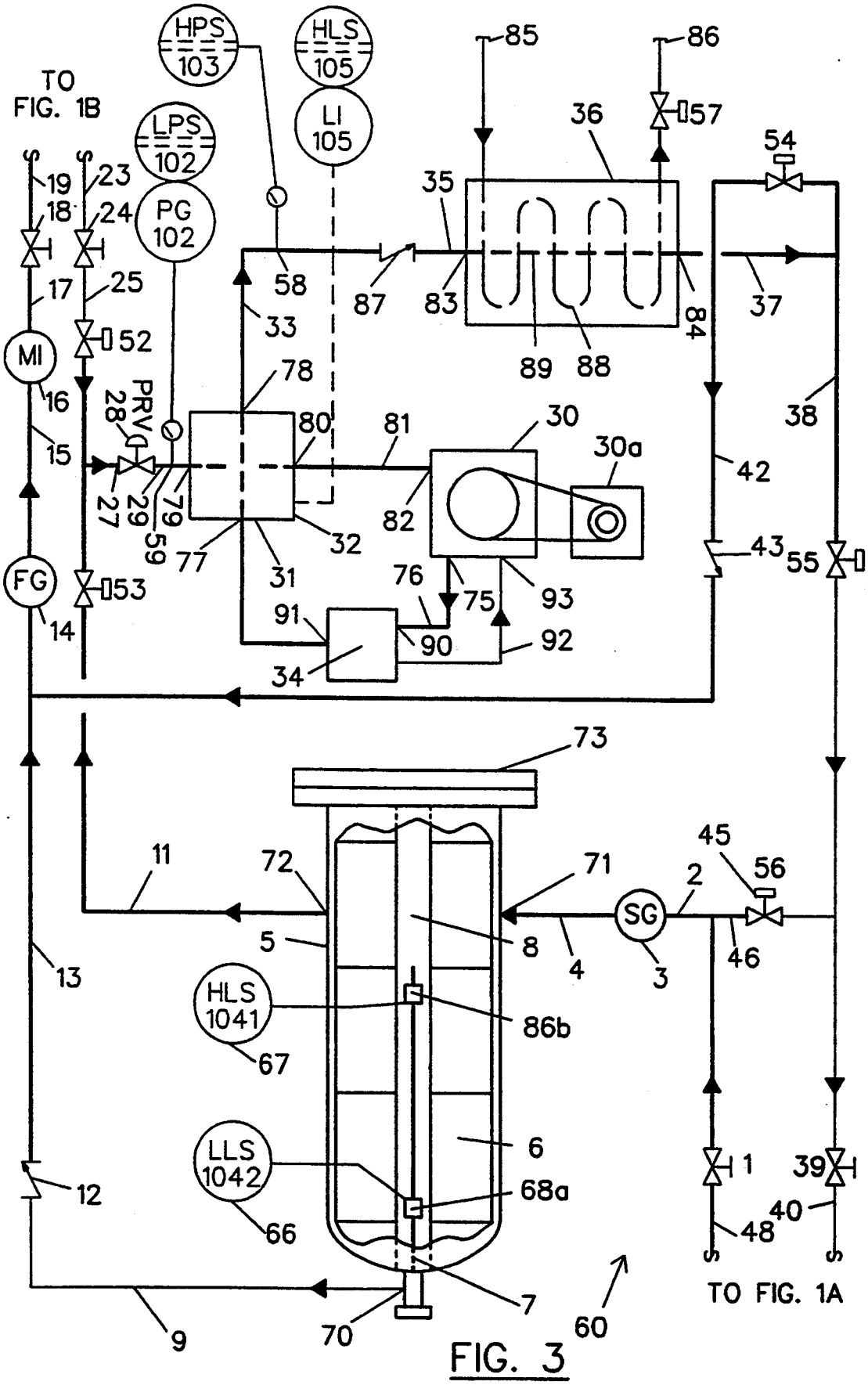
FIG. 3 is the schematic of FIG. 1 illustrating the vapor recovery mode of operation.

Referring now to FIG. 3, a schematic process flow diagram illustrates the vapor recovery mode of the system and method of the present invention. The vapor recovery mode of the present invention recovers substantially all of the remaining refrigerant vapor in refrigeration system 10 by closing SOV 55 which prevents further pressurization of the refrigeration system 10. Vacuum 30 continues to reduce pressure within refrigeration system 10 by continuing to pull vapors out through open valves 48 and 49. Refrigeration vapor from system 10 continues to be withdrawn through open valve 49, hose 48 and through open valve 1 into line 2, sight glass 3, line 4 and into inlet 71 of filter housing 5.

Refrigerant vapor exits the filter housing 5 through outlet 72 through line 11 into open SOV 53 where the vapor may only flow through PRV 28 into line 29 because SOV 52 is closed. When SOV 52 is closed, vapor exiting from tank 20 is effectively blocked. The vapor from PRV 28 passes through differentiator 31, line 81 to pressurization means 30, then out of discharge 75 through line 76 to the coalescing oil separator 34, the differentiator 31 heat exchanger, passing through inlet 77 and out outlet 78 where the heat of compression from the pressurization means is used to further vaporize any residual liquid refrigerant droplets in the vapor entering the differentiator 31. After passing through the differentiator 31, the vapors pass through the check valve 87 into the condenser 36.

The controller (FIGS. 7 and 7A) opens SOV 57 allowing cooling water to pass through water inlet 85, flow through condenser coil 88, through open SOV 57 and exit through outlet 86. The condenser 36 causes refrigerant vapor to condense to a liquid which now passes through line 37, open SOV 54 and into line 42. The liquid refrigerant continues through line 42 to check valve 43 and into line 13. Check valve 12 prevents the liquid refrigerant from back flowing into the filter housing 5.

From line 13 the liquid refrigerant passes through flow indicator and visual purity sight glass 14 through line 15 into moisture indicating sight glass 16 then out through line 17. From line 17 the liquid refrigerant flows through valve 18 which is adapted for connection to and in fluid communication with the external storage tank 20 liquid inlet valve 21 by means of hose 19. The liquid refrigerant is thus placed in the external storage tank 20. Vapor recovery continues until a predetermined low pressure such as, for example, 29 inches of Hg absolute is detected by low pressure sensor 59 which shuts off the system 60.

Reaching a pressure of 29 inches of Hg absolute is representative of substantially all of the refrigerant being removed from the refrigeration system 10. The low pressure set point of 29 inches of Hg absolute has been chosen to comply with the new environmental laws, however, the low pressure set point of the apparatus is restricted only by the capabilities of the pressurization means 30. Refrigeration system 10 now has substantially all of the refrigerant removed. By equalizing the pressure within system 10 to atmospheric pressure by breaking this vacuum with an inert gas such as nitrogen, the refrigeration system may be serviced as needed without releasing CFC refrigerants to the atmosphere.

REFRIGERANT RECYCLE MODE

Figure 4:
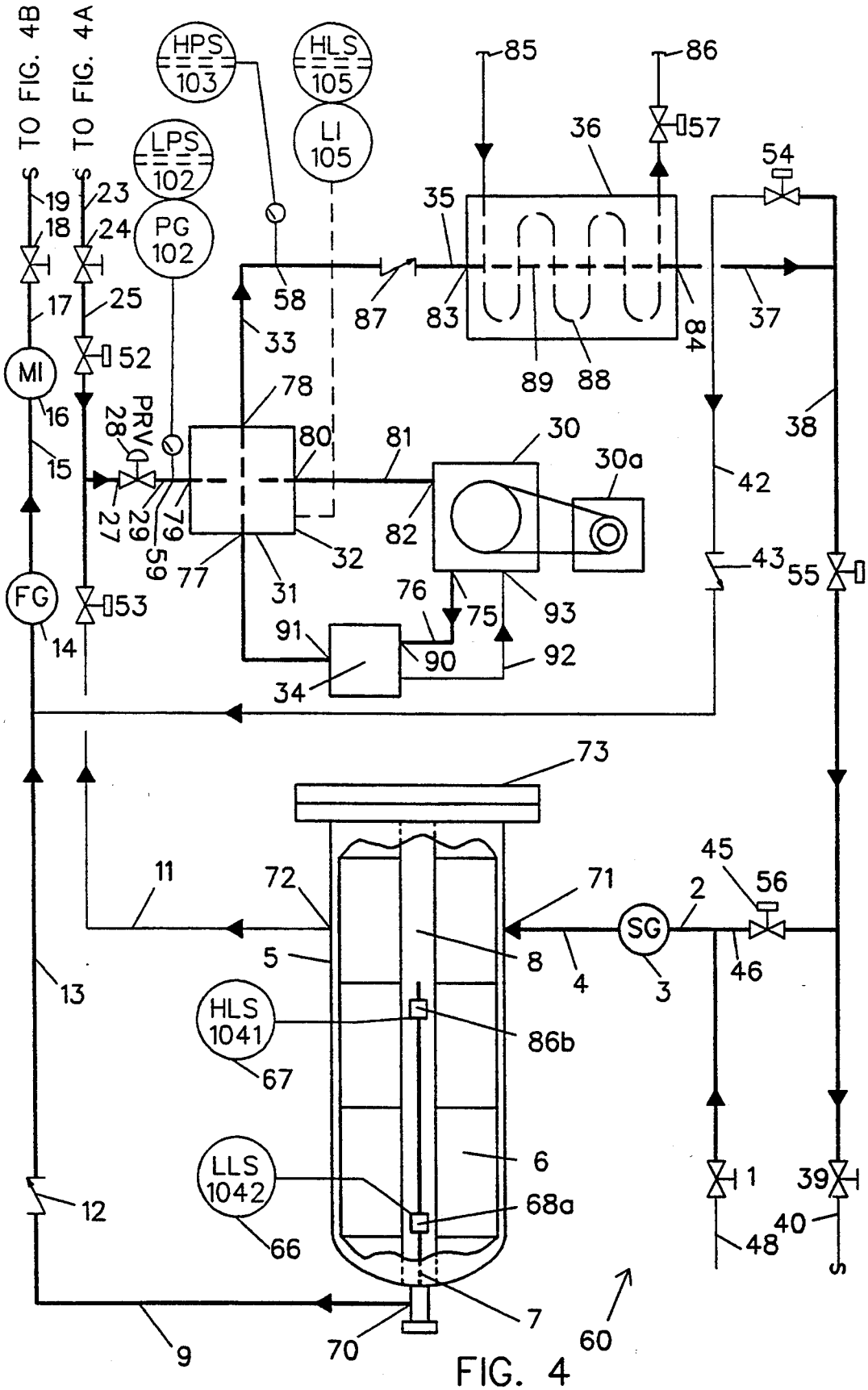
FIGS. 4, 4A and 4B are schematic process diagrams of the present invention configured for recycling contaminated refrigerant while transferring to the refrigeration system.
Figure 4B:
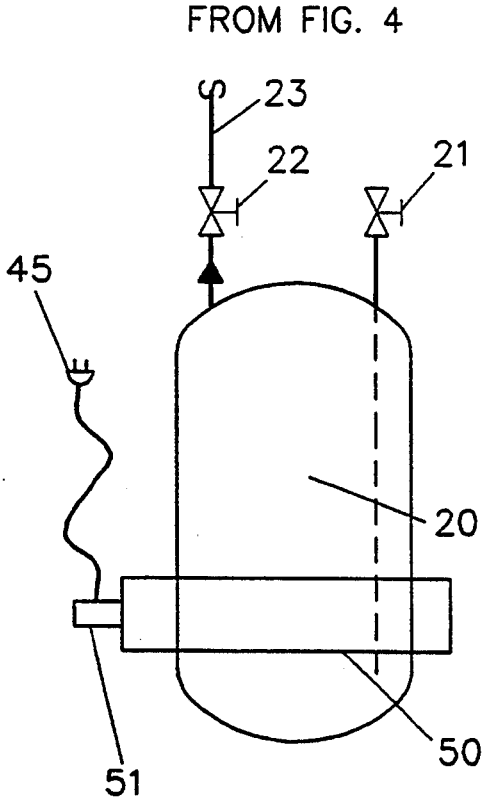
Figure 4A:
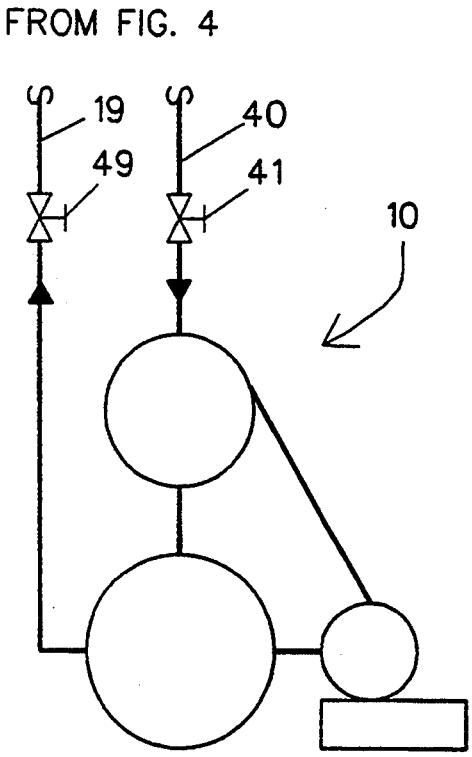

Recharging the refrigeration system 10 with the refrigerant stored in tank 20 may be accomplished by the system and method of the present invention. Referring now to FIGS. 4, 4A and 4B, a schematic process diagram illustrates the recharge and recycle mode of the present invention. To recharge the refrigeration system 10, valve 49 of the system 10 is connected to valve 18 of recycling system 60 through hose 19. The external storage tank 20, containing refrigerant, is connected to the vapor recovery inlet valve 24 by hose 23 connected to vapor valve 22. Liquid inlet valve 21 is closed for all purposes during this mode of operation.

The liquid refrigerant contained in tank 20 vaporizes as pressure is reduced therein. Pressurization means 30 causes the refrigerant vapors to flow through vapor valve 22, hose 23 and into the apparatus of the present invention at open valve 24. In addition, an external strap-on heater 50 may be attached to the lower portion of tank 20 for the purpose of heating the refrigerant contained therein. The heater 50 may be, for example, an electric heater, obtaining power from a heater electrical connection 45 which is adapted for connection to a standard 115 volt circuit supplied by an electrical circuit from the present invention. Thermostat 51 controls the maximum temperature that heater 50 may produce. Thermostat 51 may be set, for example, to 80 degrees Fahrenheit.

A temperature of 80 degrees Fahrenheit, though being sufficient to vaporize liquid refrigerant, is not of a high enough temperature to vaporize entrapped oil, water, or acids contained within the refrigerant. When the liquid refrigerant vaporizes and the vapor flows through valve 22, the majority of the oil, water, acids and solid particles remain in the tank 20. This is called distillation and effectively removes, for example, 95 percent of refrigerant contaminants. Use of temperature in conjunction with pressure reduction within tank 20, effectively evaporates any refrigerant that may be in liquid form. Thus, the desired distillation process is effectiveLv and efficiently accomplished.

The distilled refrigerant vapor travels through line 23 into valve 24 through line 25 and passes through open SOV 52 where the vapor can only flow to PRV 28 because SOV 53 is closed. The vapor continues through line 29 to differentiator 31 which prevents liquid from entering pump 30 and also vaporizes refrigerant liquid droplets back to vapor. The refrigerant vapor flows from outlet 80, through line 81 and into inlet 82 of the pressurization means 30 where the vapor is compressed and heated. The compressed and heated vapor is discharged from outlet 75, through line 76 into the coalescing oil separator filter 34 and then into the heat exchanger inlet 77 of differentiator 31. The vapor continues through line 33 into check valve 87 and out through line 35 into condenser 36. The controller has opened SOV 57, allowing cooling water to flow through coil 88 which causes the refrigerant vapor to again condense to a liquid. The condensed refrigerant liquid then flows through line 37, through open SOV 55, through line 38, and then through open SOV 56. Valves 39 and 1 are closed thus preventing refrigerant flow therethrough.

The liquid refrigerant continues through line 2 and enters filter housing 5 through inlet 71. Filter housing 5 is adapted for the use of high efficiency filters 6 that remove substantially all of the moisture and acids from the liquid refrigerant flowing therethrough. The filtered liquid refrigerant exits through outlet 70 to line 9 and through check valve 12. Continuing on through line 13, past visual purity sight glass 14, through line 15, through moisture indicator 16, through line 17 and through open valve 18 which is adapted for connection to refrigeration system 10 valve 49 by means of hose 19, where the recycled refrigerant recharges the refrigeration system 10.

The system and method of the present invention continues this recycle-recharging mode until a low pressure is detected in the external storage tank 20 by low pressure sensor 59. Upon detection of an predetermined low pressure, for example approximately 29 inch Hg absolute, the present system automatically shuts off pressurization means 30 and closes the anpropriate solenoid valves. Upon detection of the expected low pressure by low pressure sensor 59, substantially all of the refrigerant has been removed from externai storage tank 20 and placed in refrigeration system 10. This effectively completes the recharge recycle operational mode of the present invention.

VAPOR - LIQUID REFRIGERANT DIFFERENTIATOR

The differentiator 31 is used in the system of the present invention to insure that substantially no liquid passes into the suction inlet 82 of pressurization means 30. If liquid were to pass into the suction inlet 82 of pressurization means 30 a phenomenon called slugging could occur. Slugging could damage the pressurization means and prevent proper operation. The differentiator 31 is also connected to the outlet of the coalescing oil separator 34 from which refrigerant vapor from the discharge outlet 75 of the pressurization means 30 passes therethrough. This refrigerant vapor is heated by the pressurization means 30 discharge and may be used to vaporize residual refrigerant liquid droplets contained in the refrigerant vapor passing through the differentiator 31.

Referring now to FIG. 6, a schematic diagram of an elevational cross-section of differentiator 31 is illustrated. Refrigerant vapor that may contain liquid droplets of refrigerant when entering differentiator inlet 79.

The vapor with possible liquid droplets of refrigerant present flows into an inlet chamber 61 formed by diffentiator first housing 64 and baffle wall 65. Baffle wall 65 and differentiator heat exchange tube 63 form an outlet chamber 62. The baffle wall 65 within the first housing 64 separates the inlet chamber 61 from the outlet chamber 62 wherein refrigerant vapor will flow over baffle wall 65 and into chamber 62 and liquid droplets contained in the vapor will drop back into the bottom of chamber 61 due to gravity preventing the droplets overcoming the height of the baffle wall 65.

A high level sensor 32 detects the presence of liquid in chamber 61 and is placed sufficiently below the top of baffle wall 65 to detect the liquid contained in chamber 61 before it could spill over into chamber 62. Normally, chambers 61 and 62 are in vapor communication therewith and will allow vapor flow without substantial restriction. When an excess liquid level is detected in chamber 61 by the high liquid level sensor 32, the controller (not shown) will shut down the pump 30 and stop the present mode of operation causing all solenoid valves to close, thus, shutting off the system 60. The excess liquid refrigerant may be drained through differentiator liquid drain 74.

A differentiator heat exchanger tube 63 is coaxially positioned within chambers 61 and 62. Heat exchanger 63 is connected to the discharge of pressurization means 30 and uses residual heat from the compressed vapor flowing therethrough to vaporize substantially all of refrigerant liquid droplets still contained within the vapor flow. The heated vapor flowing through chamber 62 passes out differentiator vapor outlet 80 to the suction inlet 82 of pressurization means 30. The differentiator 31 effectively prevents liquids from entering the suction inlet 82 of pressurization means 30. The differentiator 31 enhances efficient operation and reliability of the system of the present invention.

ACID-MOISTURE-SOLID PARTICLE FILTER

Figure 5:
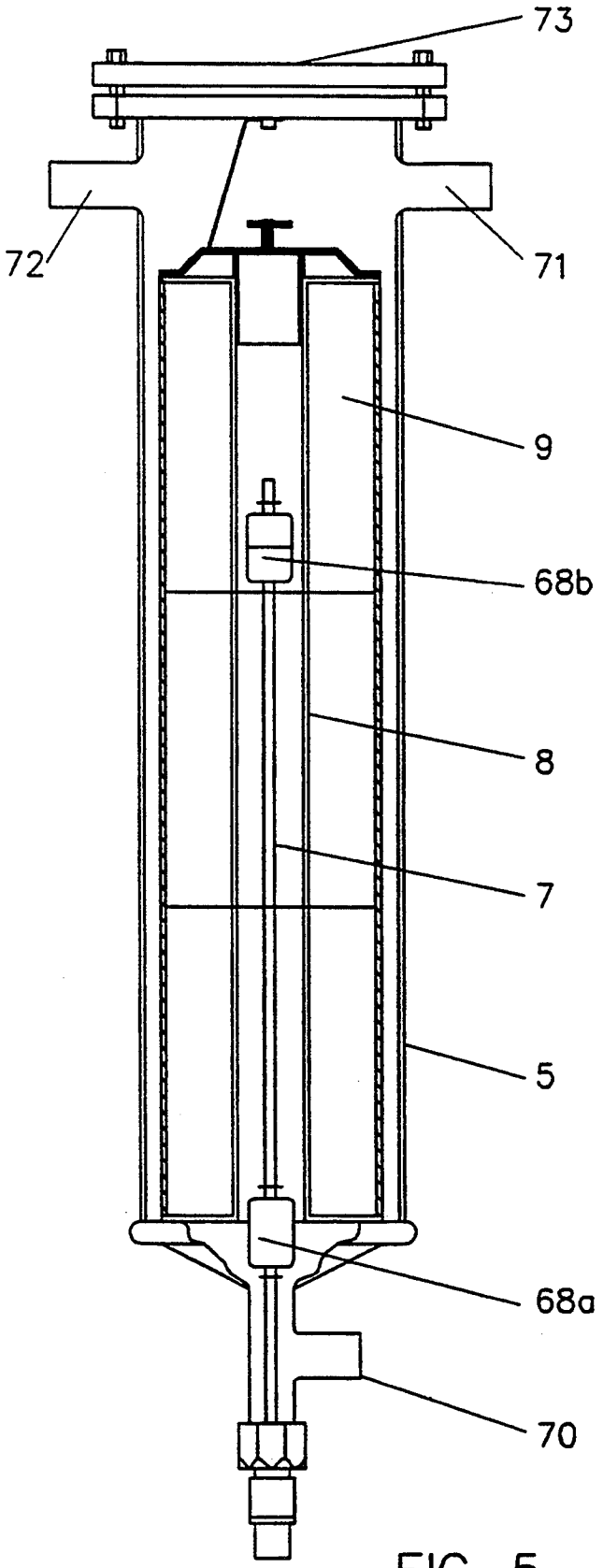
FIG. 5 is a cross-sectional elevational view of a moisture, acids and particle filter, and housing used in the present invention.

Referring now to FIG. 5, a schematic cross-sectional view of the acid-moisture-solid particle filter is illustrated. Refrigerant liquid enters inlet 71, passes through filter 7 and exits through outlet 70. The filters 6 may be chosen to either filter out solid particles during the recovery mode or moisture and acid in the recycle mode. Typical commercially available filters for removal of solid particles, moisture and acids are Sporlan No. 1098. The filters 6 may be serviced through access cover 73.

CONTROLLER

Figure 7:
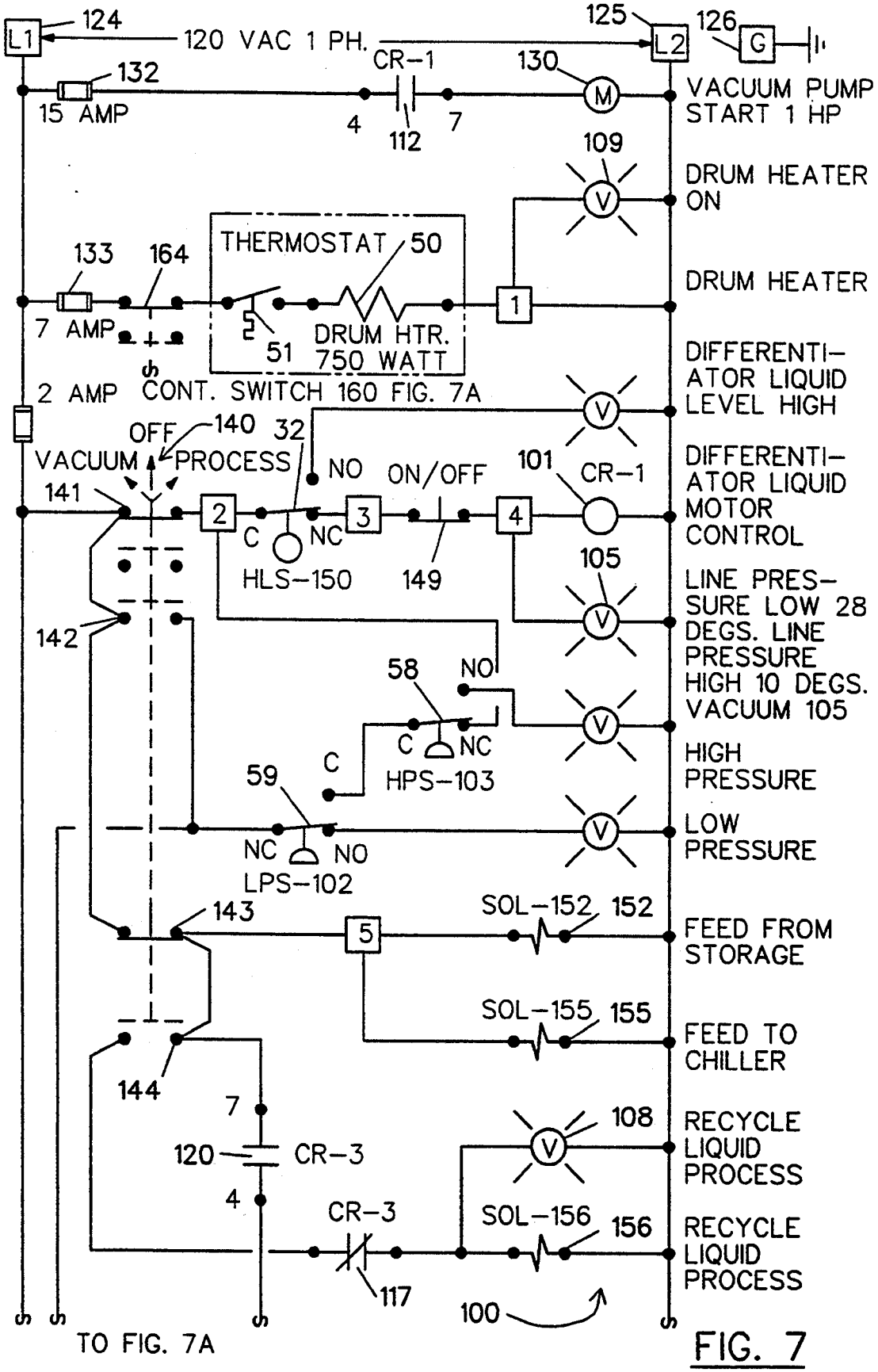
FIGS. 7 and 7A is a schematic diagram of a controller as used in the present invention.
Figure 7A:
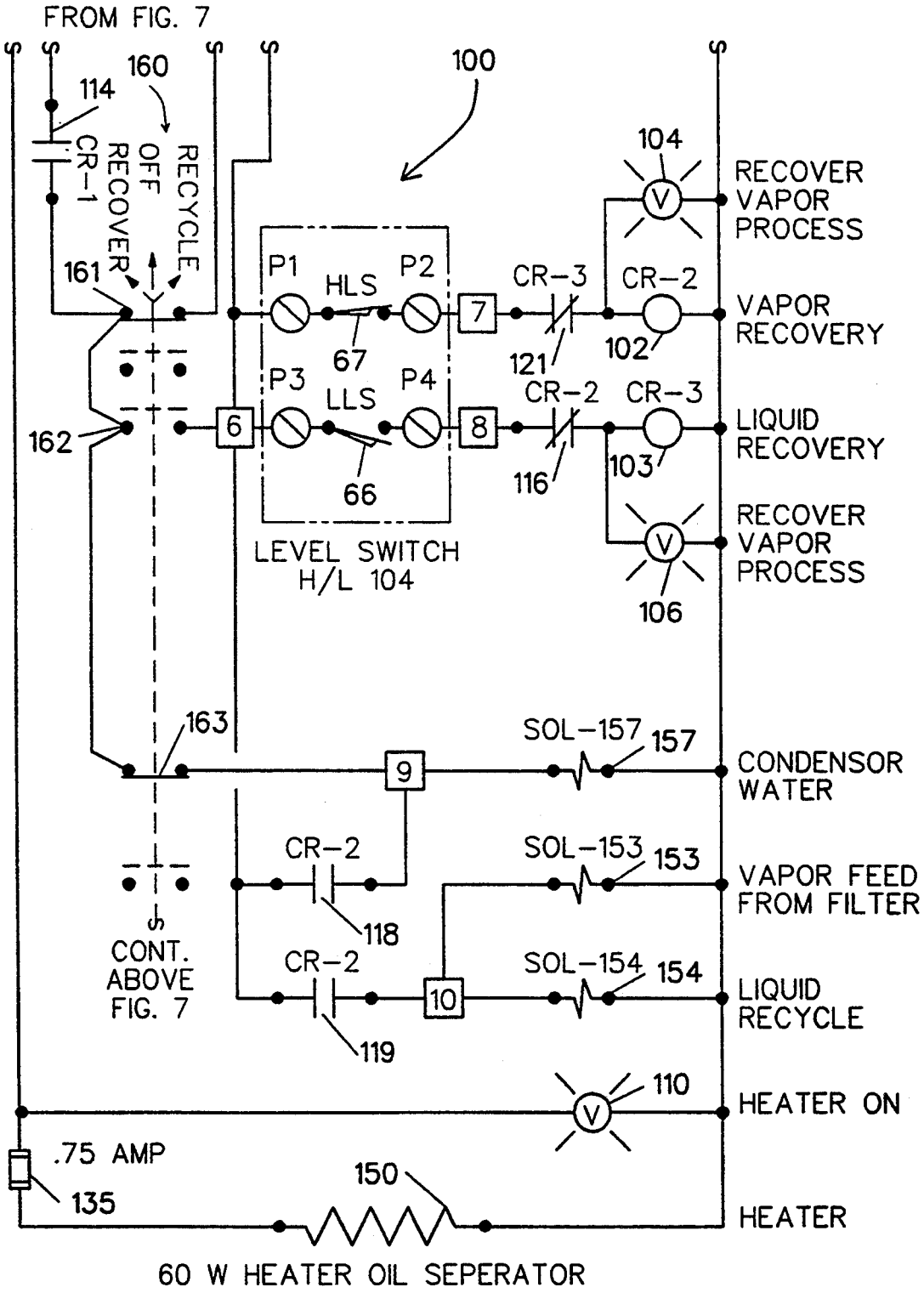

Referring now to FIGS. 7 and 7A, the reference numeral 100 generally indicates a schematic circuit diagram of a relay logic controller. The logic controller 100 may also be a programmable logic controller, solid state transistor logic controller or any other type of control means well known to those in the art of automation and process control. The logic controller 100, as illustrated in FIGS. 7 and 7A, comprises a first selector switch 140 halving switch contacts 141, 142, 143 and 144. A second selector switch 160 having contacts 161, 162, 163 and 164. An on/off switch 149. Indicator lights 105, 104, 106, 108 and 110. A first control relay having coil 101, and associated contacts 112, 113 and 114. A second control relay having coil 102 and associated contacts 116, 118 and 119. A third control relay having coil 103 and associated contacts 117, 120 and 121. A heater 150 is used to heat the coalescing oil separator 34. Indicator lights 105, 104, 106, 108 and 110 represent vacuum running, vapor recovery, liquid recovery, liquid recycle and heater 150 operational, respectively.

Power for operation of the controller 100 may be 120 volts AC single phase connected to hot input 124, neutral input 125, and safety ground to ground 126. Fuses 132, 133, 134 and 135 protect the electrical components of the present invention. Storage tank 20 heater 50 and thermostat 51 connect to controller 100 so that the heater 50 actuates only during the recycle mode. The heater 50 receives power through contact 164, which is closed only when selector switch 160 is in the recycle position.

The relay and switch control logic of the controller 100 are arranged and connected to the sensors and solenoid operated control valves of the present invention so as to automatically control the above-mentioned recovery and recycling operations. A better understanding of the control sequence of the controller 100 may be had by referring to FIGS. 1–4 and the associated descriptions thereto. The first selector switch 140 has three positions, off, vacuum and process. The vacuum position bypasses the low pressure switch 59 and high pressure switch 58 interlocks and actuates coils 152 and 155 of SOV 52 and 55, respectively. The vacuum position of switch 140 may be used in conjunction with the on/off switch 149 to turn on pressurization means 30 motor 130. The first selector switch 140, in the process position, when used in conjunction with the on/off switch 149 allows normal automated operation of the present invention. The second selector switch 160 has three switch positions, off, recovery and recycle. The recover position is used when refrigerant is being withdrawn from refrigeration system 10 into storage tank 20. The recycle position is used when removing refrigerant from storage tank 20 and recharging refrigeration system 10.

A typical refrigerant recovery operation may be performed as follows: First selector switch 140 is placed in the process position, closing switches 142, 144 and opening switches 141 and 143. Second selector switch 160 is placed in the recover position which closes switch 162 and opens switches 161, 163 and 164. When switch 142 of the selector switch 140 is closed, electrical power, flowing through fuse 134, is applied to the switch contacts of low pressure switch 59, high pressure switch 58 and high level switch 32. These switch contacts are wired in series and must all be closed for power flow through the on/off switch 149.

The operator begins the recovery operation placing on/off' switch 149 in the on position, allowing power to flow to the first control relay coil 101. Upon energizing coil 101, contacts 112 and 114 close. Coil 101 to remains energized so long as neither switch contact 142, low pressure switch 59, high pressure switch 58, high level switch 32, nor on/off switch 149 open. When contact 112 closes, pressurization means 30 motor 130 runs. Running pressurization means 30 causes liquid refrigerant to flow into filter housing 5, wherein the level of liquid refrigerant present therein is sensed by low level switch 66 and high level switch 67.

When contact 114 closes, power flows through switch contact 162 through normally closed high level switch 67, through normally closed contact 121 energizing second control relay coil 102. When coil 102 is energized, normally closed contact 116 is open, and contacts 118 and 119 are closed. Coil 102 remains energized until the liquid refrigerant level in the filter housing 5 causes high level switch 67 to open, de-energizing coil 102 and allowing contact 116 to return to its normally closed position. Third control relay coil 103 now energizes through closed low level switch 66 and closed contact 116. When coil 103 is energized, normally open contact 120 closes and normally closed contacts 117 and 121 open. So long as coil 103 remains energized, coil 102 is not energized.

Before coil 103 energizes, 102 energizes while the liquid refrigerant level rises in the filter housing 5. Coil 102 remains energized untii high level switch 67 opens, representing the filter housing 5 being substantially full of liquid refrigerant. When coil 102 is energized, contact 118 is closed, energizing SOV 57 coil 157. Contact 119 is closed energizing SOV 53 coil 153 and SOV 54 coil 154. When liquid refrigerant level causes high level switch 67 to open, contact 116 closes, energizing third control relay coil 103. When coil 103 is energized, contacts 120 close and 121 open. When contact 120 closes, SOV 52 coil 152 and SOV 55 coil 155 are energized. The liquid recovery mode continues until substantially all of the liquid refrigerant has been removed from refrigeration system 10 and there is not enough liquid refrigerant contained in filter housing 5 to maintain low level switch 66 in the closed position. When liquid level 66 opens, coil 103 de-energizes, causing contact 121 to close, re-energizing coil 102. When coil 103 de-energizes, contact 120 open, de-energizing coils 152 and 155. Re-energizing coil 102 closes contacts 118 and 119, causing coils 157, 153 and 154 to energize, thus, entering the vapor recovery mode of operation.

During the vapor recovery mode, pressurization means 30 motor 130 continues to run removing vapor from refrigeration system 10 until low pressure switch 59 senses the desired low pressure. When low pressure switch 59 opens, power is removed from coil 101, stopping motor 130. Coil 101 may also de-energize because of high pressure switch 58 opening or high level switch 32 opening, representing a system high pressure or high liquid level in the differentiator, respectively.

Placing selector switch 160 in the recycle position causes SOV 56 coil 156 to energize through contact 161 and SOV 57 coil 157 to energize through contact 163. As condensed liquid refrigerant enters filter housing 5, low ievei switch 66 closes, energizing coil 103 which closes contact 120. Closed contact 120 energizes SOV 52 coil 152 and SOV 55 coil 155. The recycle mode continues until a required low pressure is sensed by low pressure switch 59, at which time coil 101 is de-energized, stopping motor 130. The above description of controller 100 is for the purpose of disclosure, numerous changes in the details of connection and logic may be made by those skilled in the art which encompass the spirit of the invention.

May it be noted that the closed loop system of the apparatus 60 provides an environmentally protective method and apparatus for withdrawing refrigerants from the refrigeration system 10 with the ability to transfer, recycle and recharge the refrigerants into the system 10 without allowing the escape of refrigerant to the atmosphere.

The invention, therefore, is well adapted to carry out the objects and attain the ends and advantages mentioned as well as others inherent therein. While the presently preferred embodiment of the invention has been given for the purpose of disclosure, numerous changes in the details of construction and arrangement of parts, and steps of the process, will be readily apparent to those skilled in the art, and which are encompassed within the spirit of the invention and to the scope of the appended claims.

What is claimed is:

1. An apparatus for recovering liquid and vapor refrigerant from a refrigeration system and storing recovered refrigerant in a storage tank in a closed system preventing release of the refrigerant to the environment, comprising:

a refrigerant inlet adapted for connection to the refrigeration system for removal of refrigerant therefrom;

a vapor refrigerant outlet adapted for connection to the refrigeration system;

a liquid refrigerant outlet adapted for connection to the storage tank for transferring liquid refrigerant thereto;

a vapor refrigerant inlet adapted for connection to the storage tank for removal of vapor refrigerant therefrom;

a filter-separator having a filter, an inlet, a liquid outlet, a vapor outlet, and a first liquid level sensor detecting liquid level within said filter-separator, said filter-separator inlet connected to the refrigerant inlet and said filter-separator liquid outlet connected to the liquid refrigerant outlet;

a compressor having a suction inlet and discharge outlet;

a condenser having an inlet and an outlet, said condenser inlet in fluid communication with the compressor discharge outlet;

an initially open first valve connecting the vapor refrigerant inlet to the compressor inlet and an initially open second valve connecting the condenser outlet to the vapor refrigerant outlet for initially providing a pressure differential between the storage tank and the refrigeration system for transferring liquid refrigerant from the refrigeration system to the storage tank;

an initially closed third valve between the filter-separator vapor outlet and the compressor inlet, and an initially closed fourth valve between the condenser outlet and the liquid refrigerant outlet;

said first liquid level sensor connected to and controlling the initially open first and second valves and the initially closed third and fourth valves and closing the first and second valves and opening the third and fourth valves when said liquid level sensor detects an absence of liquid refrigerant in said filter-separator thereby withdrawing vapor refrigerant from the refrigeration system, condensing the vapor into a liquid and storing the condensed liquid refrigerant in the storage tank.

2. The apparatus of claim 1, further comprising:

a low pressure sensor connected to said vapor-liquid differentiator and used for detecting a desired low pressure; and a controller having a liquid recovery first mode and a vapor recovery second mode, wherein the first mode controls withdrawing the liquid refrigerant from the refrigeration system and into the external storage tank, and the second mode controls withdrawing the vapor refrigerant from the refrigeration system, condensing the vapor into a liquid and storing the liquid in the external storage tank until said low pressure sensor detects a desired low pressure value representative of substantially all of the refrigerant being removed from the refrigeration system.

3. The apparatus of claim 1, further comprising a high pressure sensor connected to said vapor-liquid differentiator and used for detecting a high pressure.

4. The apparatus of claim 1, wherein said filter-separator comprises;

a removable filter medium for filtering out rust and dirt particles from the liquid refrigerant;

a filter screen coaxially positioned within said filter medium;

said first liquid level sensor having a high liquid level signal and a low liquid level signal; and a chamber housing having an access cover, an inlet, a vapor outlet and a liquid outlet, said filter medium, filter screen and liquid level sensor are contained therein;

wherein, the refrigerant enters said chamber inlet and is filtered by said filter medium and filter screen, said liquid level sensor detects the level of liquid refrigerant contained within said chamber housing such that the high liquid level signal indicates when said chamber housing is substantially full and the low liquid level signal indicates when said chamber housing is substantially empty, the filtered liquid refrigerant exits through said chamber liquid outlet, refrigerant vapor exits through said chamber vapor outlet, and said filter medium and screen may be serviced through said access cover.

5. The apparatus of claim 1, wherein said first liquid level sensor comprises high and low level switches actuated by a float.

6. The apparatus of claim 1, wherein said differentiator comprises:

a first housing forming an inlet chamber having a vapor inlet, said inlet chamber vapor inlet connected to said filter-separator vapor outlet;

a second housing forming an oulet chamber having a vapor outlet, said outlet chamber coaxially positioned within said inlet chamber and in vapor communication therewith, said outlet chamber vapor outlet connected to said compressor suction inlet; and a heat exchanger coaxially positioned within said outlet chamber and in thermal communication therewith, said heat exchanger connected between said compressor discharge outlet and said condenser;

wherein liquid droplets of refrigerant are separated from the vapor refrigerant and collect within said inlet chamber, collected liquid refrigerant is vaporized into vapor by heat from said heat exchanger.

7. The apparatus of claim 6, further comprising:

a liquid drain in said first housing for draining a high liquid level accumulated within said inlet chamber; and a second liquid level sensor for sensing the high liquid level accumulated within said inlet chamber and adapted to stop said compressor;

wherein said compressor stops when the high liquid level is sensed by said second liquid level sensor and then the accumulated high liquid level is drained through said liquid drain.

8. The apparatus of claim 1, wherein said condenser is a heat exchanger comprising:

a refrigerant conduit; and a water conduit, said refrigerant and water conduits in thermal communication therewith, wherein water flowing through said water conduit cools the vapor refrigerant in said refrigerant conduit causing the refrigerant to condense into a liquid.

9. The apparatus of claim 1, wherein said condenser is a heat exchanger comprising:

a refrigerant conduit; and an air cooling means in thermal communication with said refrigerant conduit.

10. The apparatus of claim 1, further comprising a pressure reducing valve between said filter-separator vapor outlet and said differentiator for preventing over pressuring of said compressor.

11. The apparatus of claim 1, further comprising a coalescing oil separator for removing oil introduced into the refrigerant vapor by said compressor and for returning the removed oil to said compressor, said coalescing oil separator connected to the discharge outlet of said compressor.

12. The apparatus of claim 1, further comprising a check valve for preventing liquids from flowing back into said vapor-liquid differentiator, said check valve connected between said vapor-liquid differentiator and said condenser.

13. The apparatus of claim 2, further comprising a thermostatically controlled heater adapted for attachment to the external storage tank for supplying heat thereto.

14. The apparatus of claim 13, further comprising a controller having a recycle mode, wherein the recycle mode controller controls said heater, removal of the distilled refrigerant vapor from the external storage tank, condensing of the refrigerant vapor into a liquid until said low pressure sensor detects a desired pressure value representative of substantially all refrigerant being recycled from the external storage tank to the refrigeration system.

15. The apparatus of claim 13, further comprising a filter means for removing moisture and acids from the liquid refrigerant being recycled.

16. The apparatus of claim 1, further comprising a portable handcart frame and wheels for ease in transportation and setup by one person.

17. The apparatus of claim 2, wherein the desired pressure value is less than or equal to 20 inches of mercury absolute.

18. A system for recovering liquid and vapor refrigerant from a refrigeration system and storing recovered refrigerant in a refrigerant storage system in a closed system preventing release of the refrigerant to the environment, said system comprising:

means for withdrawing the refrigerant liquid from the refrigeration system and into the refrigerant storage system by increasing the pressure within the refrigeration system to a pressure greater than the pressure within the refrigerant storage system;

means for filtering the refrigerant liquid;

means for withdrawing the refrigerant vapor from the refrigeration system by decreasing the pressure therein after withdrawing substantially all of the refrigerant liquid;

means for condensing the refrigerant vapor to a liquid; and means for storing the condensed refrigerant in the refrigerant storage system until reaching a desired pressure value representative of substantially all of the refrigerant being withdrawn from the refrigeration system.

19. A method for recovering liquid and vapor refrigerant from a refrigeration system and storing recovered refrigerant in a refrigerant storage system in a closed system preventing release of the refrigerant to the environment, said method comprising the steps of:

withdrawing the refrigerant liquid from the refrigeration system and into the refrigerant storage system by increasing the pressure within the refrigeration system to a pressure greater than the pressure within the refrigerant storage system;

filtering the refrigerant liquid;

withdrawing the refrigerant vapor from the refrigeration system by decreasing the pressure therein after withdrawing substantially all of the refrigerant liquid;

condensing the refrigerant vapor to a liquid; and storing the condensed refrigerant in the refrigerant storage system until reaching a desired pressure value representative of substantially all of the refrigerant being withdrawn from the refrigeration system.

20. The method of claim 19, further comprising the steps of:

distilling refrigerant by vaporizing the refrigerant stored in the refrigerant storage system to remove oil, water, acids and particles therefrom;

removing the vaporized refrigerant from the refrigerant storage system;

condensing the vaporized refrigerant to a liquid;

filtering the distilled and condensed refrigerant liquid to remove substantially all of remaining moisture and acids therefrom; and recharging the refrigeration system with the distilled, condensed and filtered refrigerant liquid.

21. The method of claim 19, further comprising the step of differentiating liquid refrigerant droplets from vapor refrigerant wherein the liquid droplets drop off the vapor refrigerant into a collection chamber wherein the collected liquid refrigerant is vaporized back into a vapor by heat.

22. The method of claim 19, further comprising the step of removing oil from the refrigerant vapor by means of a coalescing oil separator.

23. The method of claim 19, further comprising the step of differentiating liquid refrigerant droplets from vapor refrigerant wherein the liquid refrigerant droplets drop off the vapor refrigerant into a collection chamber wherein the collected liquid refrigerant is vaporized back into a vapor by heat.

24. A method for recovering liquid and vapor refrigerant from a refrigeration system and storing recovered refrigerant in a storage tank in a closed system preventing release of the refrigerant to the environment, said method comprising the steps of:

withdrawing the refrigerant liquid from the refrigeration system and into a filter-separator by increasing pressure in the refrigeration system while decreasing pressure within the filter-separator, wherein liqujid refrigerant flows from the higher pressure refrigeration system into the lower pressure filter-separator;

sensing the level of liquid refrigerant in the filter-separator to determine a liquid recovery first mode and a vapor recovery second mode;

wherein the first mode comprises the steps of;

withdrawing the refrigerant liquid from the refrigeration system, through the filter-separator and into the storage tank by increasing pressure in the refrigeration system while decreasing pressure in the storage tank, wherein liquid refrigerant flows from the higher pressure refrigeration system into the lower pressure storage tank;

filtering the liquid refrigerant flowing from the refrigeration system through the filter-separator until substantially no liquid remains in the filter-separator; wherein the second mode comprises the steps of;

withdrawing the refrigerant vapor from the refrigeration system, through the filter-separator and into a condenser by decreasing pressure within the filter-separator;

sensing the pressure of the refrigerant vapor;

condensing the refrigerant vapor to a liquid; and storing the condensed refrigerant liquid in the storage tank until the refrigerant vapor pressure is at a desired low pressure value representative of substantially no more refrigerant remaining in the refrigeration system.

25. The method of claim 24, further comprising the steps of:

distilling refrigerant by vaporizing the refrigerant stored in the external storage tank to remove oil, water, acids and particles therefrom;

removing the vaporized refrigerant from the storage tank;

condensing the vaporized refrigerant to a liquid;

filtering the distilled and condensed refrigerant liquid to remove substantially all of the remaining moisture and acids therefrom; and returning the distilled, condensed and filtered liquid refrigerant to the refrigeration system.

26. The method of claim 24, further comprising the step of removing oil from the refrigerant vapor by means of a coalescing oil separator.

* * * * *